United States Patent [19]

Derton et al.

[11] 4,135,659

[45] Jan. 23, 1979

[54] HORIZONTAL CENTRIFUGAL SEPARATOR

[75] Inventors: Harry E. Derton, Cahokia, Ill.; Dewey M. Cope, Affton, Mo.

[73] Assignee: Centrifugal & Mechanical Industries, Inc., St. Louis, Mo.

[21] Appl. No.: 739,708

[22] Filed: Nov. 8, 1976

[51] Int. Cl.[2] ..... B04B 1/08; B04B 1/12

[52] U.S. Cl. ..... 233/3; 233/29; 233/47 R; 210/369; 210/382

[58] Field of Search ..... 233/46, 47 R, 21, 22, 233/27, 32, 2, 3, 29, 28; 210/377, 379, 380 R, 380 H, 376, 378, 369, 382

[56] References Cited

U.S. PATENT DOCUMENTS

| | | | |
|---|---|---|---|
| 1,745,853 | 2/1930 | Krantz | 233/1 R |
| 2,104,683 | 1/1938 | Rosen et al. | 233/29 |
| 2,353,983 | 7/1944 | Banning | 233/46 |
| 2,549,968 | 4/1951 | Hachmuth | 233/22 X |
| 2,695,133 | 11/1954 | Drury | 233/2 |
| 2,941,872 | 6/1960 | Pilo et al. | 233/29 X |
| 3,301,708 | 1/1967 | Rotel | 233/46 X |
| 3,368,684 | 2/1968 | Ruegg | 210/377 X |
| 3,946,940 | 3/1976 | Tadokoro | 233/2 |

FOREIGN PATENT DOCUMENTS

| | | | |
|---|---|---|---|
| 146859 | 6/1952 | Australia | 233/2 |

*Primary Examiner*—George H. Krizmanich
*Attorney, Agent, or Firm*—Paul M. Denk

[57] ABSTRACT

In a horizontal centrifugal separator there is included a housing that rests by means of cushioned supports upon the ground, foundation, or the like, with the housing providing for the bearing mounting of a shaft that connects with a revolvable bowl, with both of said shaft and bowl being arranged substantially along a horizontal axis; the bowl includes a series of vanes extending from its interior surface, arranged between its base and the rim portion, with the rim portion having a series of perforations therethrough so as to allow for separation of the coolant from the metal chips as accumulated in the metal working industry. A chute also mounts upon the housing and has its discharge end extending into the bowl, and further includes a deflector that is arranged approximate its end, and therein allows for the continuous delivery of chips to the bowl and their uniform distribution along its interior surface to facilitate the centrifugal separation of any coolant from the chips.

10 Claims, 7 Drawing Figures

HORIZONTAL CENTRIFUGAL SEPARATOR

BACKGROUND OF THE INVENTION

This invention relates generally to centrifugal separation, and more specifically pertains to a horizontally disposed centrifugal separator that conveniently delivers, evenly distributes, and locates the coolant laden chips within the zone of separation within the separator so as to efficiently remove any residue coolant for collection and eventual reuse, while simultaneously drying the chips in preparation for their sale.

Various types of centrifugal separators are available in the prior art, but most of such separators are rather intricately designed for use specifically in separating generally liquid materials of differing specific gravities. One such centrifuge is shown in the United States patent to Hultsch, et. al., U.S. Pat. No. 3,864,256, while similar type of centrifugal separators are disclosed in the United States patents to Wendt, U.S. Pat. No. 3,674,206; to Stoermer, U.S. Pat. No. 3,072,323; and, the United States patent to Coulson, U.S. Pat. No. 3,081,027. The current invention is more concerned with the provision of a chip wringer, and therein provide for the separation of a coolant, and oils, from the residue chips or metallic turnings that are generally milled from metal components during manufacturing, so that the chips can be reasonably cleaned of any such oil, dried by the centrifugal function, with the segregated oil being collected for reuse in the cooling process as during a machinery operation.

Other prior art patents have given some consideration to the disposition of a horizontal centrifuge, and even one that utilizes vibratory motion to attain movement of the centrifuged solids from its rotating basket. But, while the current invention incorporates some of the familiar aspects of such prior art, as shown in the United States patent to Wirth, U.S. Pat. No. 2,991,887, the current invention is designed to significantly improve upon such earlier type of separator so as to attain much more efficiency in its output, while at the same time function in a more effective manner.

It is, therefore, the principal object of this invention to provide a more effective means for separating chips or other solid components from its coolant fluids, oils, or other liquid material.

A further object of this invention is to provide a horizontally disposed centrifugal separator that incorporates vaned structure within its revolving bowl so as to provide for uniform distribution of entering chips around the interior surface of the said bowl.

A further object of this invention is to provide a conveniently disposed chute means that deposits a quantity of the wetted chips into the vicinity of the revolving bowl at the location of its base so as to provide for the fullest action of the centrifugal forces in achieving liquid separation as the chips glide towards and momentarily seat at the separator screen structured about the rim of the said bowl.

a further object of this invention is to provide a horizontal centrifugal separator that during functioning can accommodate a greater capacity in the treatment of either steel, brass, aluminum, or other metallic chips in separating them from their wetting coolant.

Another object of this invention is to provide a centrifugal separator that is of compact size, and yet is cushioned in its mounting so as to reduce exposure of the surrounding vicinity from any vibrations, and to likewise dampen the noises of operation of the machine during usage.

A further object of this invention is to furnish a centrifugal separator that can reclaim to a high degree of efficiency the coolant and oils normally adhering to metal turnings and chips produced during machine shop operations.

These and other objects will become more apparent to those skilled in the art upon reviewing the summary of this invention, and upon undertaking a study of the description of the preferred embodiment in view of its drawings.

SUMMARY OF THE INVENTION

The centrifugal separator of this invention has been designed as of the horizontal type, and which contemplates revolving a shaft mounted bowl about a horizontal axis while continuously and automatically feeding a supply of wetted turnings or mass produced parts into its interior to attain an effective separation of any adhering liquid material from the surface of such solid components or parts. The shaft and bowl means of this invention are conveniently disposed and bearing mounted with a housing that furnishes structural integrally or provides full support for the various instrumentalities associated with this separator during its functioning, with said housing providing integral support for the hopper and chute into which and through the wetted solid components are delivered initially to the revolving bowl means of this invention. The bowl means itself includes proximate its rim portion a cylindrical shaped segment that is perforated, generally formed of a series of axially parallel aligned rods, that provide the slotted surface through which the oil aspect of the wetted chips may be discharged, as through the influence of the centrifugal whirling, while the chips further glide along said rods for eventual discharge from the rim portion of the bowl. Disposed surrounding the terminal rim portion of the bowl, and formed of the housing itself, is a receiver into which the deoiled solid components are discharged, with the receiver having a downward opening that provides for a gravitational channeling of the cleaned components to a location of collection. The housing is also formed having a chamber provided surrounding the rim portion of the bowl, and provides a location for accumulation of the discharged coolant and oil effluents during the separator's centrifugal functioning.

The apparatus of this invention is further designed to comply with the various federal and local regulations normally requiring that safety features be designed into current machinery for the protection of employees. The apparatus, and more particularly its housing, is mounted upon rubber or other cushioned suspensions, such as rubber gaskets, and which are designed to dampen the transfer of any vibrations into the surrounding vicinity, and at the same time, significantly reduces the noises of operation of this centrifugal separator.

The separator of this invention has been designed to accommodate high speed operation, in addition to supporting continuous operation for the purpose of attaining high efficiency in the recovery of oil or other coolants from metal, parts, and chips. For example, in the preferred embodiment, a machine in the capacity of a 3000 pound separator generally incorporates a 10 to 15 horsepower motor that allows for the achievement of a speed of rotation of the bowl means in the vicinity of 1200 rmp. And, such an apparatus incorporates an effective separation area in the vicinity of 450 square inches of perforated surface of screen that can effectively deoil steel chips at the capacity of 8000 pounds per hour, brass chips in the vicinity of 8800 pounds per hour, and aluminum chips in a capacity of 1500 pounds per hour. Results of this magnitude can be attained due to the continuous functioning and generation of the centrifugal forces within the separator, since the chute means of this invention can be repeatedly charged for delivery of the chips continuously to the separating bowl. Such capacity is highly efficient over the batch type of centrifugal separators heretofore available, since this particular invention provides for the continuous discharge of the dry solids from the separating bowl, while the oils and coolants are centrifugally delivered to a chamber for eventual disposition within a reservoir, and which reservoir may be continuously or periodically tapped for removal of the collected liquids for reuse.

DESCRIPTION OF THE PREFERRED EMBODIMENT

Figure 1:
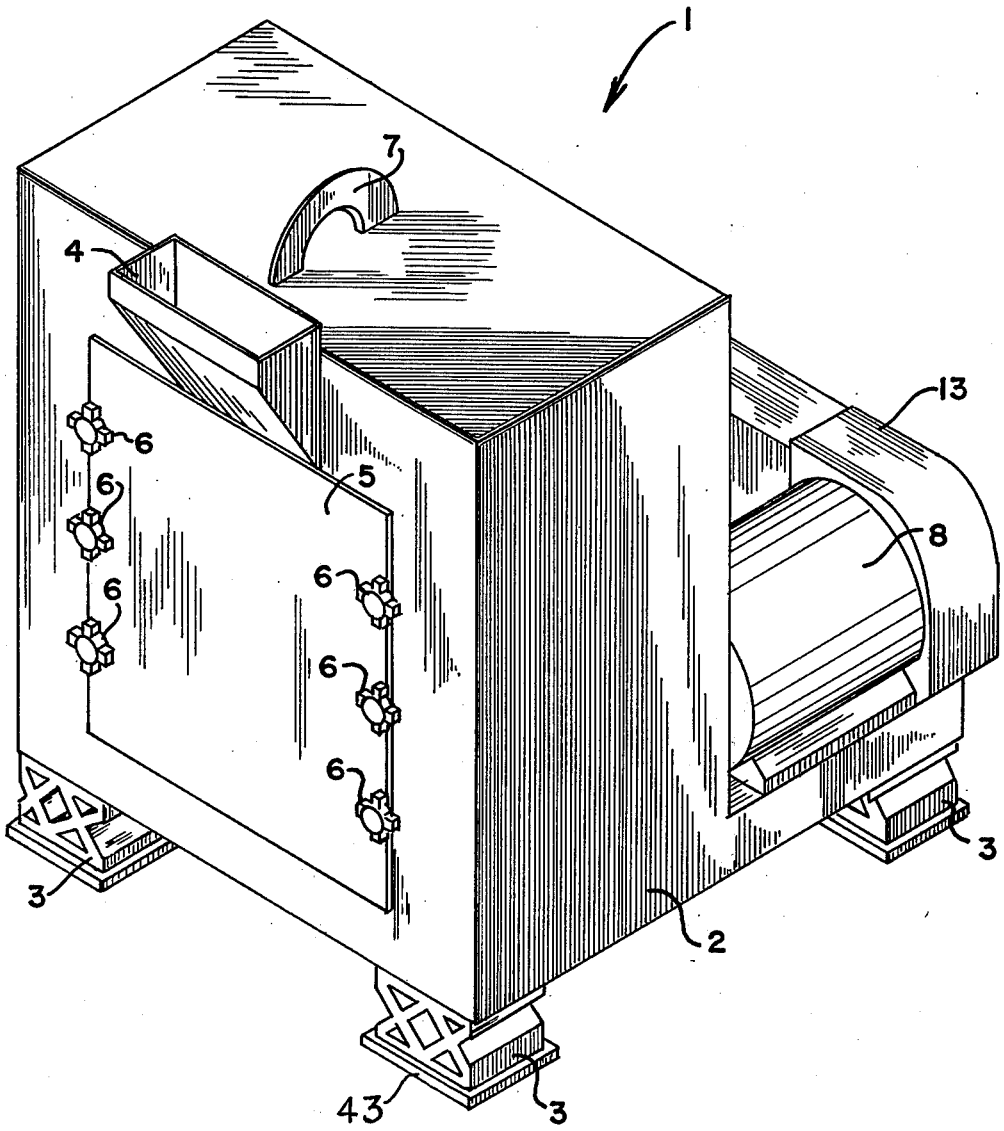
FIG. 1 furnishes an isometric view of the horizontal centrifugal separator of this invention.
Figure 2:
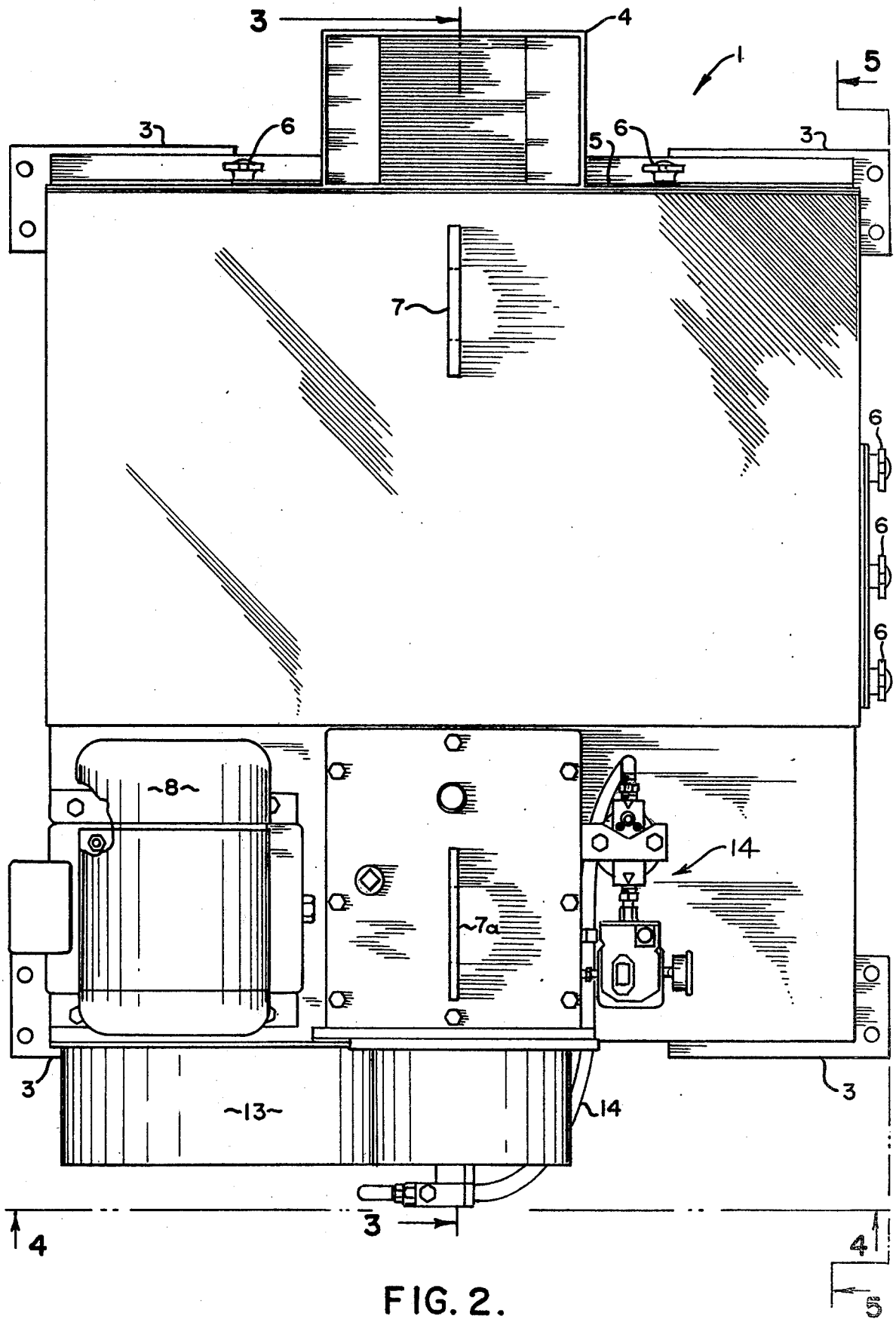
FIG. 2 provides a plan view of the centrifugal separator of this invention.

In referring to the drawings, and in particular FIGS. 1 and 2, there is disclosed the horizontal centrifugal separator 1 of this invention, which comprises a housing 2 that may be supported upon a series of vibration and noise dampening cushions 3 that support the housing spacedly from the floor of the industrial plant in which the apparatus may be located. These cushions 3 may be formed of any type of durable rubber or other resilient polymer that effectively dampens the transfer of any vibrations to the floor or the surrounding vicinity of the plant, and at the same time lessens the noises associated with the operations of such a separator. Provided at the upper frontal portion of the separator is charging hopper 4 and into which the moistened and wetted solid components, such as metal turnings, chips, or even small mass produced parts, may be deposited and subjected to the operations of this separator. A cover 5 is rigidly held to the front side of separator by means of a series of removal retainers 6 so that convenient access may be made into the interior of the apparatus either for its cleaning, parts replacement, or for other servicing. Extending integrally from the upper side of the separator is an enlarged catch 7 and which is disposed for convenient reception of a hook of a crane or other conveyor so that the entire apparatus can be conveniently transferred as required. A similar catch 7*a* is provided rearwardly of housing to facilitate its conveyance. See Also FIG. 5.

Figure 3:
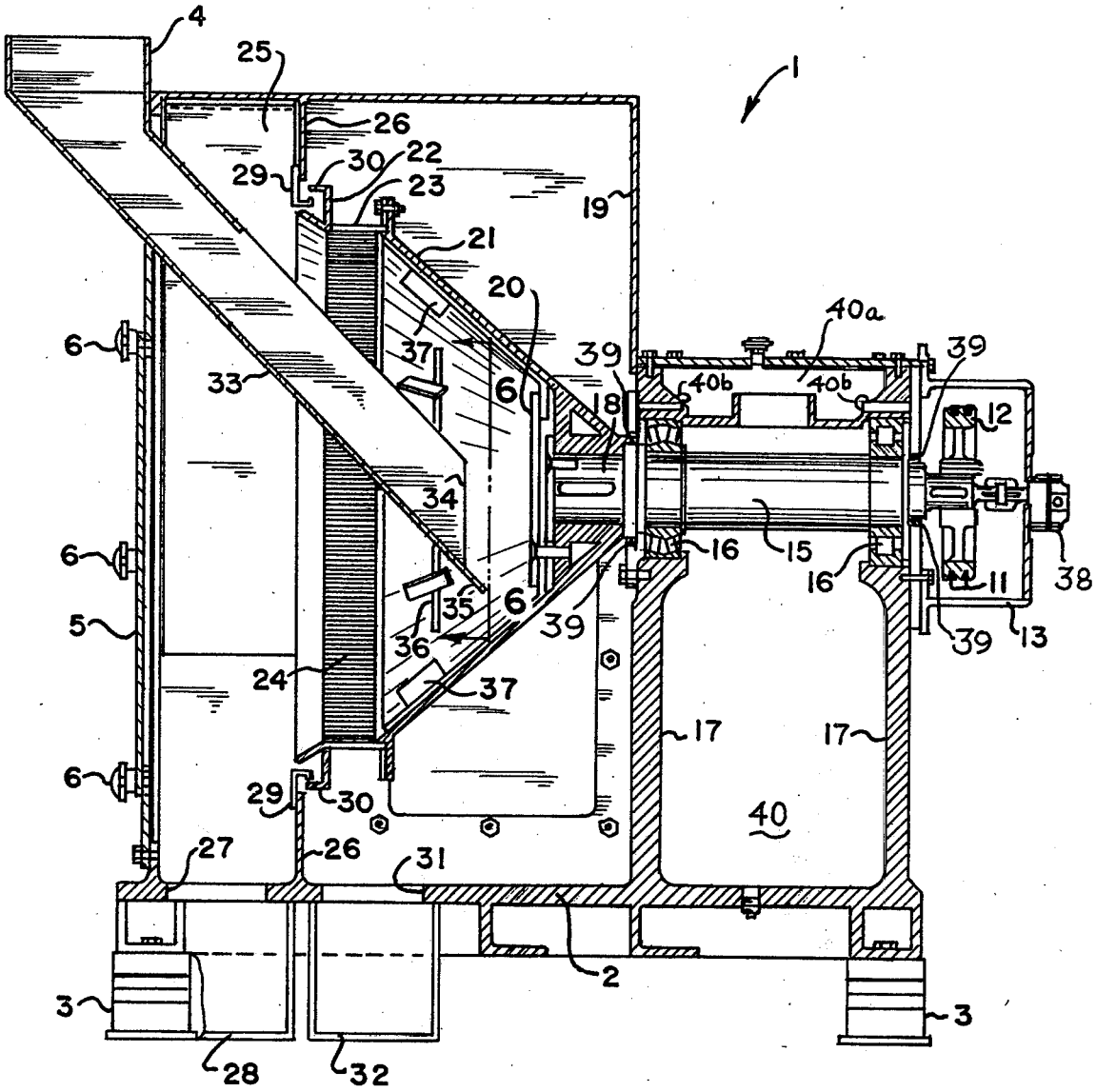
FIG. 3 provides a sectional elevational view of the centrifugal separator of this invention taken along the line 3—3 of FIG. 2.

Disposed resting upon the back section of the housing 2 is an electric motor 8, of a size or capacity designed to provide the degree of revolutions to the components associated with the internal operations of this separator, and which motor, as in the preferred embodiment, may be manufactured as an alternating current motor having a horsepower rating somewhere in the vicinity of 10 to 15 hp, as aforesaid. The output shaft 9 of the motor has mounted thereon a pulley 10, and which pulley has upon it a belt means 11 that provides for transfer of motor power to another pulley 12 that furnishes rotating movement for attaining the internal operations of this separator. A guard 13 shields these revolving components so as to prevent their exposure to the workmen, and eliminate this as a source of injury to the workers. See also FIGS. 3 and 4 for a display of these described components.

Figure 5:
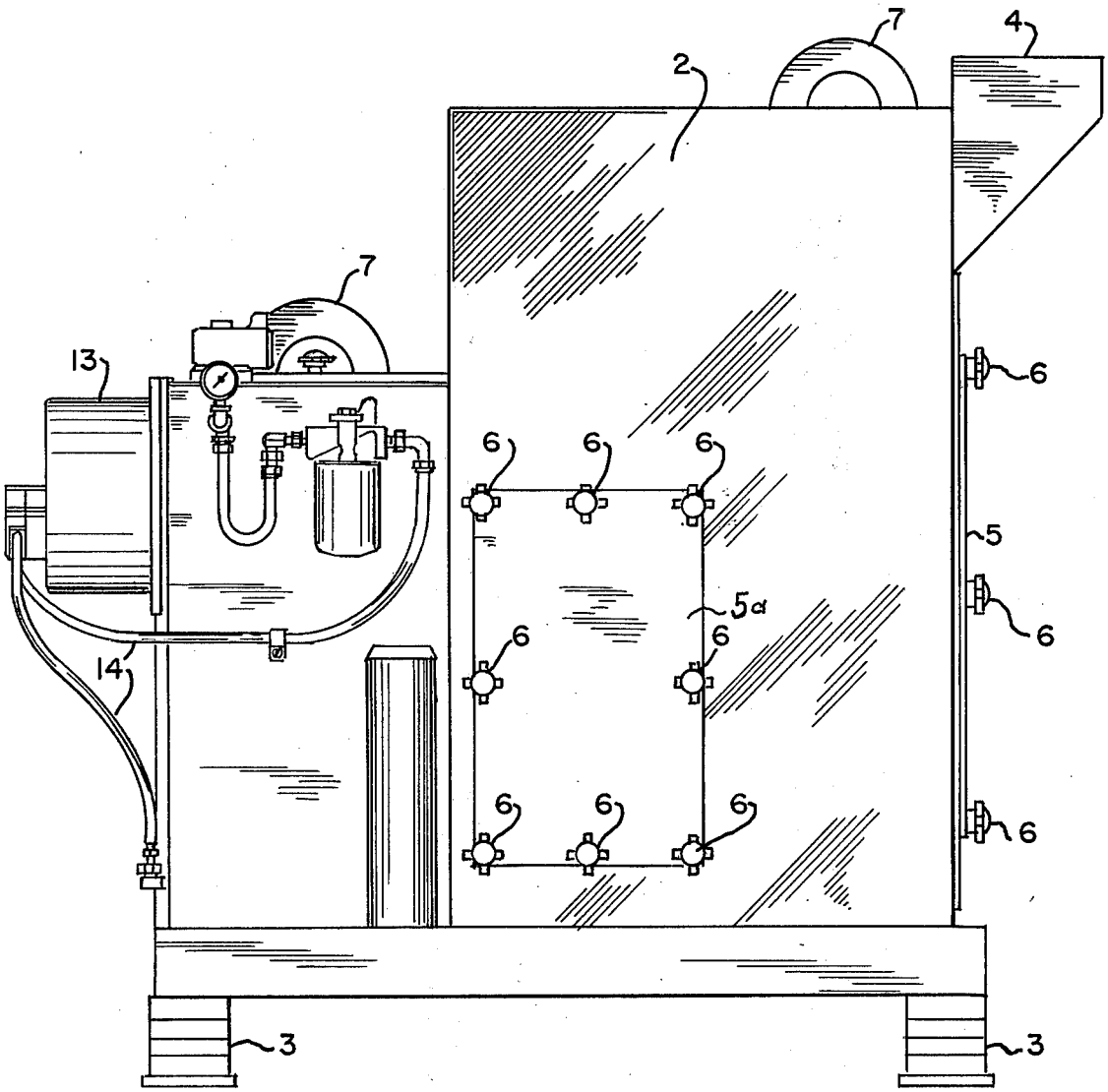
FIG. 5 furnishes a side elevational view of the centrifugal separator of this invention.

FIG. 5 discloses a left side elevational view of the housing 2 of this invention, and displays the various oil lines 14 and lubricating means that are associated with the separator and provide for the convenient supply of lubricating oils to the various operating components of this separator as will be hereinafter described. Another cover 5*a* secured by fasteners 6*a* is provided at this side of the separator.

By referring once again to FIG. 3, it can be seen that the pulley 12 mounts upon the back end of a shaft 15, and which shaft is mounted, by means of the bearings 16, upon the supports 17 integrally formed of the housing structure 2. It can be herein seen that the housing 2 provides the structural reinforcement necessary to furnish stability to this separator during its operations. The forward end 18 of the shaft 15 extends into a chamber 19 formed of the housing 2, and this end of the shaft is rigidly secured by means of fasteners to the base 20 of a separator bowl 21 of this invention. This bowl means 21 is cantilever supported within the chamber 19 of the housing soley through its attachment to the end 18 of the shaft, and upon a rotation of the shaft 15, as by operation of the motor means 8, the bowl will revolve about its horizontal axis at speeds equivalent to those sufficient to generate the degree of centrifugal forces necessary to attain separation of a liquid, such as a coolant and cutting oil, from any metal turnings or chips deposited into this separator bowl.

The bowl means 21 flares outwardly from its base 20 and to the vicinity of its rim 22, and proximate this rim segment of the bowl there is provided a cylindrical portion 23 and whereat the actual separation of liquid from the solid components is accomplished. This cylindrical portion 23 of the bowl is in the nature of a screen, provided with perforations, so as to allow for the passage of the coolant and cutting oils therethrough, and more specifically this portion is formed of a series of parallel arranged metal strips or rods, as at 24, which are integrally arranged and secured within this rim segment of the bowl to form a grate thereat. The spacing between the rods is designed to be of sufficient width so as to allow for the passage of a liquid material therethrough, as when exposed to the centrifugal forces of the revolving bowl, but at the same time retard and prevent the passage of any metal turnings, or other solid components or parts, through the same. The chamber 19 of the housing is separated from a receiver 25, formed of the same housing 2, as by means of a series of spacers 26. The receiver 25 is designed for its location adjacent to the outer marginal edge of the rim 22, so that the metal turnings or parts moving through the bowl are eventually discharged or thrown into this receiver, and then gravitate to its lower reaches for passage through the opening means 27 for collection within the bin 28. So as to prevent the intermingling of any of the parts discharged into the receiver 25 with any of the oils collecting within the chamber 19, the spacers 26 include an angled portion 29, around its inner perimeter, and which cooperate with a structured portion 30 securing upon the revolving rim portion 22 of the bowl and prevent access between the said chamber 19 and receiver 25.

The chamber 19 also includes an aperture means 31 through the housing 2, and includes a collecting vessel 32 therebelow to also provide for the gravity collection of any separated oils or coolant therein.

Figure 6:
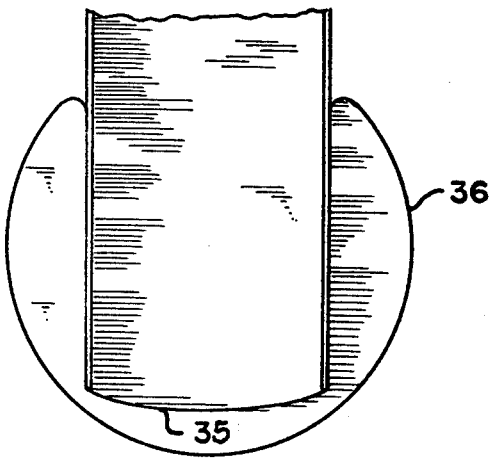
FIG. 6 provides an end view of the delivery chute and deflection plate of this invention, taken along the line 6—6 of FIG. 3.

The housing 2 supports at its upper frontal portion the hopper 4, and which hopper communicates with a chute 33 that leads downwardly and inwardly into the interior of the separator, and more particularly in a direction towards the base 20 at the interior of the bowl means 21. The lower end 34 of the chute is arranged in proximity to the base 20, and this end of the chute has an arcuate lip 35 that conveniently directs the incoming chips into this vicinity of the revolving bowl. Proximate the end 34 of the chute 33 there is secured a deflector plate 36 which is designed, as can be seen from FIG. 6, of rather circular configuration having a diameter substantially less than the interior diameter of the bowl at this location. This deflector is provided at this location so as to assure that none of the chips or turnings entering into the bowl will ricochet out of the same before coming under the influence of the centrifugal forces that effectively separate any of the coolant and oils adhering to the same. Hence, should any chip be cast by the rapidly revolving bowl in a direction towards its rim, it generally will encounter the deflector plate, be impeded from its line of flight, and fall onto the rotating surface of the bowl. And, at this location, the bowl incorporates a series of spaced vanes 37 that serve a two-fold purpose. The first to gather any of the chips falling from the deflector plate and urge their direction into the influence of the centrifugal forces of the revolving bowl, and secondly, said vanes are useful for providing a means for uniformly distributing the incoming chips around the entire interior surface of the bowl as they are continuously fed into the same by means of the hopper and its chute combination. Hence, there is little likelihood, due to the location of the radially extending vanes as shown, that the chips can accumulate at any particular location along the surface of the bowl, and hence, cause an imbalance in the bowl revolutions. And, by uniformly distributing the chips entirely throughout the surface of the bowl as they re fed into the separator allows for an even accumulation of the chips eventually at the location of the cylindrical segment 23 of its rim so that the layer of accumulated chips spread evenly around the circumference of the strips 24 will be subjected to the maximum influence of the centrifugal forces generated by the rapidly revolving bowl and cause the coolants and oils adhering to said chips to be cast outwardly and into the chamber 19, with the chips further gradually gliding along the surface of the segment 23 and eventually being cast from the rim end 22 of the bowl means, and into the receiver 25. Hence, clear separation of the chips from any adhering liquid is effectively accomplished through the uniform operations of a bowl means that incorporates the various structural features as herein described, and which in practice has been highly effective in producing significant savings in the reclaiming of coolant and oils from metal turnings or chips, and even smaller parts that may be cleaned and dried in the separator of this type. In practice, as much as 98% of coolant has been reclaimed through the operations of this separator, and such reclaiming can reduce the annual coolant requirements of a plant by as much as 22 to 23 percent.

Figure 7:
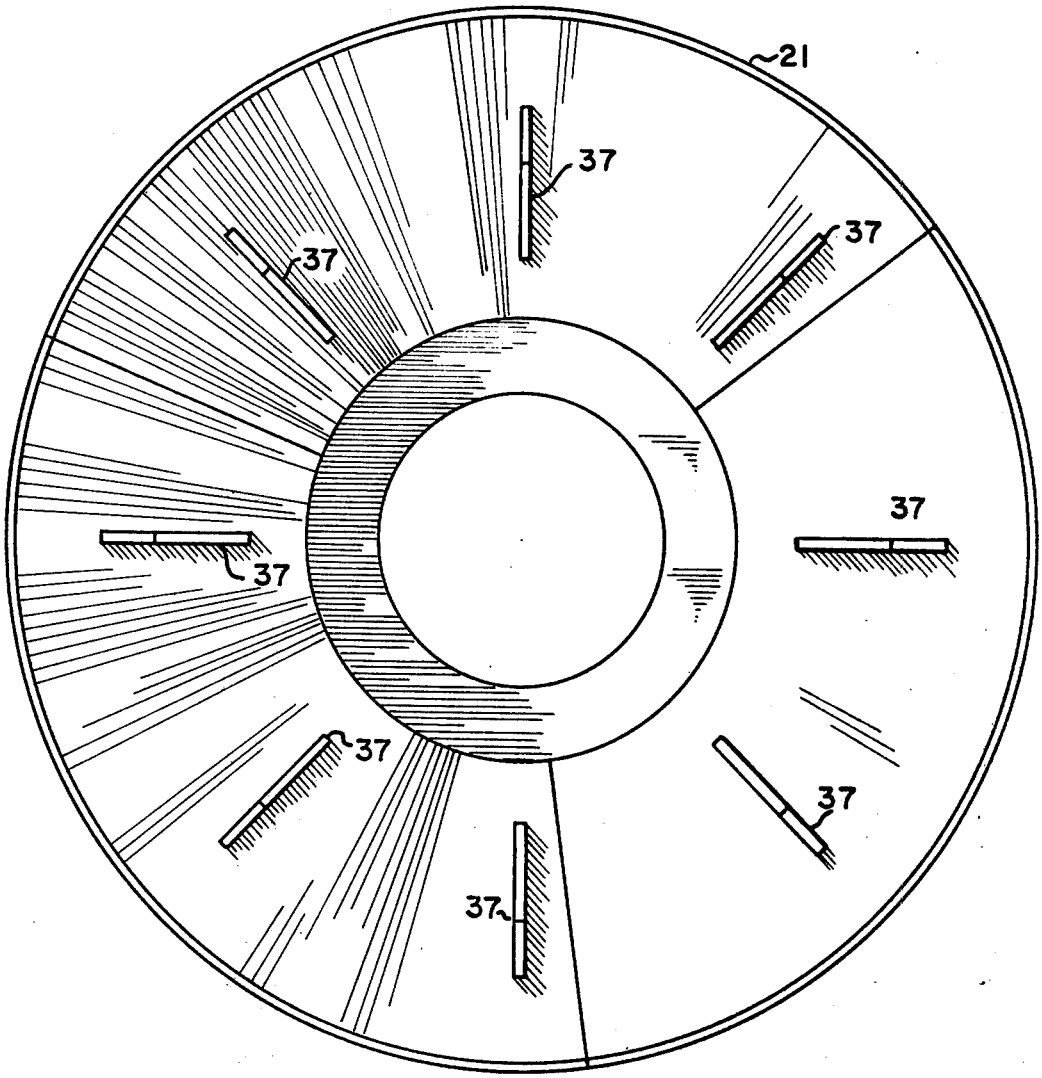
FIG. 7 provides an end view of the separator bowl of this invention disclosing the location of its base and vanes.

The precise location of the vanes 37 uniformly around the interior perimeter of the bowl means 21 is more aptly disclosed in FIG. 7. These vanes are arranged radially within the bowl and extend inwardly therefrom, with the vanes having a length that is less than the distance between the rim and base portion of the bowl means, as shown.

It may also be commented that the lubricating means 14 of this invention is designed to provide for the feeding of various lubricating oils to the vicinity of the bearing mounts 16 between the shaft 15 and the housing supports 17. As can further be seen from FIG. 3, the lubricating oils are pumped from the reservoir 40 by a direct driven gear pump 38 into a distribution sump **40*a*, with the oils then traversing by way of the cavities 40*b* to the vicinity of the various bearings 16. And, the various oil seals 39 prevent the leakage of the lubricating oils to the exterior of this vicinity of the housing, and any residue oil dripping from the location of the lubricating the bearings 16 will fall downwardly into the oil reservoir 40, provided within the rearward side of the housing 2. And, as can be seen also in FIG. 4, an oil line 41 secures proximate the bottom portion of this oil reservoir 40 and therein pumps reserved oil from this location back up into the vicinity of the bearings 16 so as to provide for constant lubrication and the near frictionless turning of the shaft 15 within the housing 2**.

Figure 4:
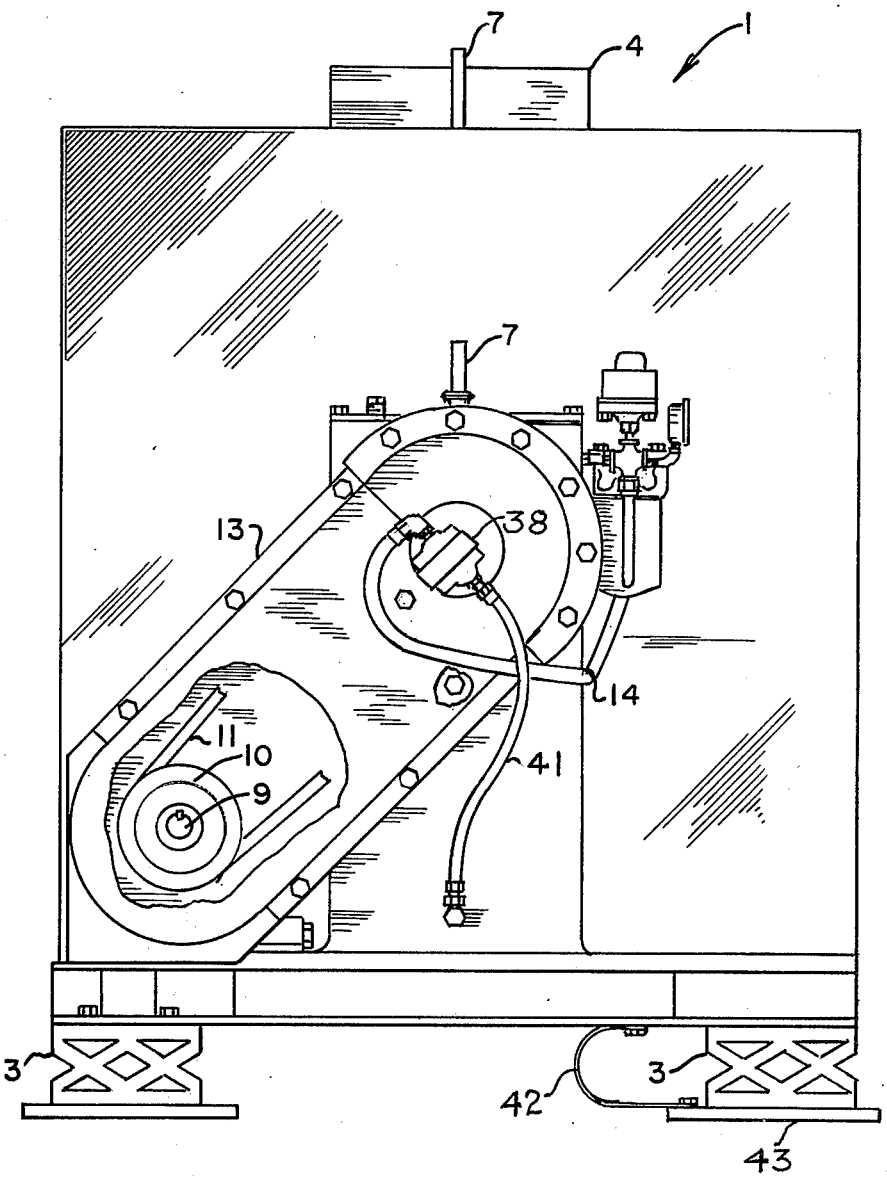
FIG. 4 provides a back view of the centrifugal separator of this invention.

To provide for the proper grounding of this separator, and as can be seen in FIG. 4, a grounding wire 42 connects between the base of the housing 2, and to the base plate 43 of the shown cushioning member 3.

Various modifications to the invention as disclosed herein may occur to those skilled in the art upon reviewing the subject matter of this invention. For example, it is just as likely that the deflector, as suspended within the bowl, may be supported from the housing itself rather than be connected to the end of the chute. Such modifications, if within the spirit of the principle of this invention, and encompassed by the scope of the claims appended herein, are intended to be protected by any United States patent issuing hereon. The disclosure of the preferred embodiment is set forth for illustrative purposes only.

Having thus described the invention what is claimed and desired to be secured by Letters Patent is:

1. A centrifugal separator for use in segregating a liquid material from wetted solid components, and to attain an approximate drying of said solid components, comprising, an open bowl means arranged for revolving about an approximate horizontal axis, said bowl means having a rim and a base, a shaft means coupling to said bowl means and provided for supporting the same during its horizontal rotation, said bowl means flaring outwardly in a direction away from said shaft means and towards its opening, a housing provided for supporting said bowl and shaft means in rotation, motor means associated with said housing and upon energization capable of rotating said bowl and shaft means, said bowl means having perforations at least proximate its rim to accommodate the separation of said liquid from the solid components arranged therein and to attain an approximate drying of the said solid components, said perforated rim portion being disposed with respect to its integral bowl to provide for a temporary retention of the said solid components during their movement towards discharge out of the said bowl and to stimulate their said drying thereat, with the force of the incoming solid components urging the removal of previously deposited and temporarily retained solid components away from the said perforated rim and out of the said bowl, a chute mounted upon said housing and extending into the said flared open end of said bowl means for deposition of the said wetted components proximate its base, a deflector disposed within the bowl means and connecting to one of said housing and chute and provided for facilitating the transfer of said entering components into the influence of the centrifugal forces generated by the revolving bowl means, and vane means provided upon the inner surface of said bowl means proximate said deflector to facilitate the uniform arrangement and temporary accumulation of the incoming solid components within the said rotating bowl means.

2. The invention of claim 1 wherein said rim having a cylindrical portion being disposed concentrically of the said horizontal axis of the bowl means, and said rim perforations being arranged through the said cylindrical portion of said rim.

3. The invention of claim 2 wherein said perforated rim comprises a series of spaced rods, said rods being coaxially aligned with the horizontal axis of rotation of the bowl means, and the spacing between said rods being sufficient to pass any liquid material therethrough while preventing the passage of any solid components.

4. The invention of claim 3 and including a chamber surrounding the perforated portion of the bowl means and arranged for receiving any liquid material centrifugally discharged therefrom, and means disposed downwardly of the chamber for facilitating the collection of any liquid material deposited within said chamber.

5. The invention of claim 4 and including a receiver provided upon the housing and arranged adjacent to the rim of the bowl means, said receiver disposed for reception of any solid components centrifugally discharged from the said bowl means, and means disposed downwardly from the receiver for facilitating the gravity collection of any solid components thereat.

6. The invention of claim 2 and wherein said vane means comprise a series of vanes connecting to and extending inwardly of the bowl means and approximately radially disposed of its deflector, said vanes arranged for inducing the uniform distribution about the interior of the bowl means of any solid components delivered thereto, with the uniform distribution of the said solid components being centrifugally urged outwardly of the said bowl means and providing the force necessary for effecting discharge of previously deposited solid components from the cylindrically formed portion of the perforated rim.

7. The invention of claim 6 wherein said series of vanes are equally spaced about the interior of the bowl means, and said vanes extend radially inwardly from the same.

8. The invention of claim 7 wherein said vanes have a length less than the distance between the rim and the base of the bowl means.

9. The invention of claim 8 wherein said vanes are arranged approximately circumferentially aligned with the separator deflector.

10. The invention of claim 1 and including lubricating means operatively disposed of the housing and provided for furnishing a lubricant to the horizontally disposed shaft means to facilitate its rotation.

* * * * *